US010777931B2

(12) United States Patent
Fukazawa et al.

(10) Patent No.: US 10,777,931 B2
(45) Date of Patent: Sep. 15, 2020

(54) MODULAR ELECTRICAL CONNECTOR ASSEMBLY

(71) Applicant: Tyco Electronics Japan G.K., Kanagawa (JP)

(72) Inventors: Takeki Fukazawa, Kanagawa (JP); Takafumi Kubo, Kanagawa (JP)

(73) Assignee: Tyco Electronics Japan G.K., Kawasaki-shi (JP)

( * ) Notice: Subject to any disclaimer, the term of this patent is extended or adjusted under 35 U.S.C. 154(b) by 0 days.

(21) Appl. No.: 16/223,633

(22) Filed: Dec. 18, 2018

(65) Prior Publication Data

US 2019/0190187 A1 Jun. 20, 2019

(30) Foreign Application Priority Data

Dec. 20, 2017 (JP) ..... 2017-243505

(51) Int. Cl.
*H01R 13/504* (2006.01)
*H01R 13/645* (2006.01)
(Continued)

(52) U.S. Cl.
CPC ..... *H01R 13/5045* (2013.01); *H01R 13/405* (2013.01); *H01R 13/5202* (2013.01);
(Continued)

(58) Field of Classification Search
CPC ..... H01R 24/84
See application file for complete search history.

(56) References Cited

U.S. PATENT DOCUMENTS 2,384,267 A * 9/1945 Andersen ..... H01R 24/84 439/293
3,129,993 A * 4/1964 Ross ..... H01R 13/64 439/294
(Continued)

FOREIGN PATENT DOCUMENTS

EP 289014 A2 * 4/1988 ..... H01R 13/523
JP 2010170946 A 8/2010
(Continued)

OTHER PUBLICATIONS

Abstract of JP WO2016063377, dated Apr. 28, 2016, 2 pages.
Abstract of JP 2010287454, dated Dec. 24, 2010, 1 page.
Abstract of JP 2010170946, dated Aug. 5, 2010, 1 page.

*Primary Examiner* — Tho D Ta
(74) *Attorney, Agent, or Firm* — Barley Snyder

(57) ABSTRACT

A connector assembly comprises a first subassembly having a male contact and a first inner housing accommodating the male contact, a second subassembly having a female contact configured to be mated with the male contact and a second inner housing accommodating the female contact, a first connector, and a second connector matable with the first connector. The first connector has a first outer housing accommodating one of the first subassembly and the second subassembly and capable of accommodating both the first subassembly and the second subassembly. The second connector has a second outer housing accommodating the other of the first subassembly and the second subassembly and capable of accommodating both the first subassembly and the second subassembly.

20 Claims, 12 Drawing Sheets

(51) Int. Cl.

| | |
|---|---|
| ***H01R 13/405*** | (2006.01) |
| ***H01R 13/52*** | (2006.01) |
| ***H01R 13/627*** | (2006.01) |
| ***H01R 24/84*** | (2011.01) |
| *H01R 13/74* | (2006.01) |

(52) U.S. Cl.
CPC ..... *H01R 13/5219* (2013.01); *H01R 13/6277* (2013.01); *H01R 13/6456* (2013.01); *H01R 24/84* (2013.01); *H01R 13/746* (2013.01)

(56) References Cited

U.S. PATENT DOCUMENTS 3,840,839 A * 10/1974 Smaczny ..... H01R 13/631 439/294
4,500,980 A * 2/1985 Copeland ..... H02G 15/14 367/154
4,923,413 A * 5/1990 Michaels ..... H01R 4/72 439/284
5,752,847 A * 5/1998 McCormick ..... H01R 13/635 439/310
5,800,196 A * 9/1998 Rudoy ..... H01R 24/84 439/284
6,220,891 B1 * 4/2001 Hils ..... H01R 13/6598 439/284
6,857,903 B2 * 2/2005 Hyde ..... H02G 3/123 439/284

FOREIGN PATENT DOCUMENTS

JP 2010287454 A 12/2010
JP WO2016063377 A1 4/2016

* cited by examiner

MODULAR ELECTRICAL CONNECTOR ASSEMBLY

CROSS-REFERENCE TO RELATED APPLICATION

This application claims the benefit of the filing date under 35 U.S.C. § 119(a)-(d) of Japanese Patent Application No. 2017-243505, filed on Dec. 20, 2017.

FIELD OF THE INVENTION

The present invention relates to a connector assembly and, more particularly, to a connector assembly including a first connector and a second connector mated with the first connector.

BACKGROUND

A connector assembly including a pair of matable connectors each having housings that are identical in shape and accommodating hermaphroditic contacts is disclosed in International Patent Application No. WO2016/063377. In a case in which a connector has a male contact and a mating connector has a female contact, the connector assembly disclosed in WO 2016/063377 does not permit changing the combination of housings and female/male contacts. That is, the connector assembly disclosed in WO 2016/063377 does not apply when the external shape of one connector is determined.

A connector on a power supply side, for example, may have a female contact so that a user's finger or the like cannot accidentally touch the contact. There are applications in which one connector is on a power supply side and an application where one connector identical in external shape is on a power receiving side, yet one of the connectors has a female contact and one has a male contact; the connector assembly disclosed in WO 2016/063377 also cannot be adapted to these applications. Separately designing and manufacturing two types of connectors having housings identical in external shape and accommodating a male contact and a female contact is conceivable, however, the number of types of parts increases, increasing manufacturing cost.

SUMMARY

A connector assembly comprises a first subassembly having a male contact and a first inner housing accommodating the male contact, a second subassembly having a female contact configured to be mated with the male contact and a second inner housing accommodating the female contact, a first connector, and a second connector matable with the first connector. The first connector has a first outer housing accommodating one of the first subassembly and the second subassembly and capable of accommodating both the first subassembly and the second subassembly. The second connector has a second outer housing accommodating the other of the first subassembly and the second subassembly and capable of accommodating both the first subassembly and the second subassembly.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
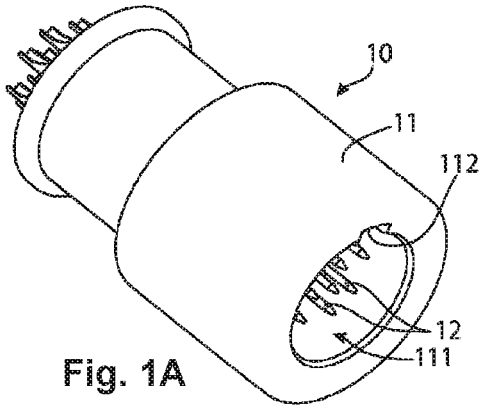
FIG. 1A is a perspective view of a first connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

Figure 1B:
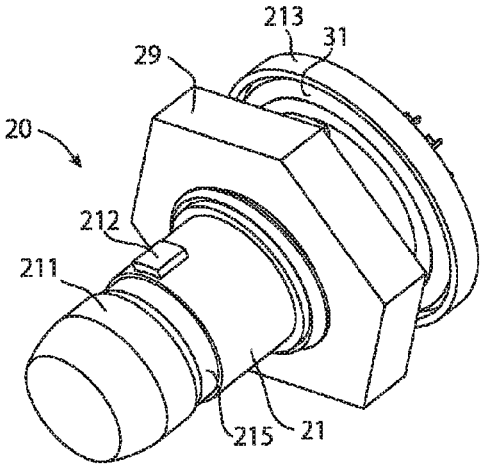
FIG. 1B is a perspective view of a second connector matable with the first connector of FIG. 1A.
Figure 2A:
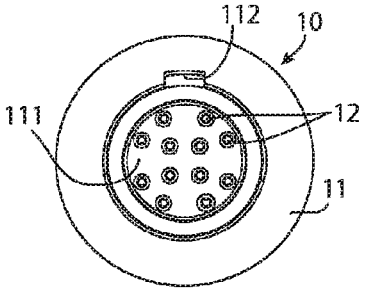
FIG. 2A is a front view of the first connector of FIG. 1A.
Figure 2B:
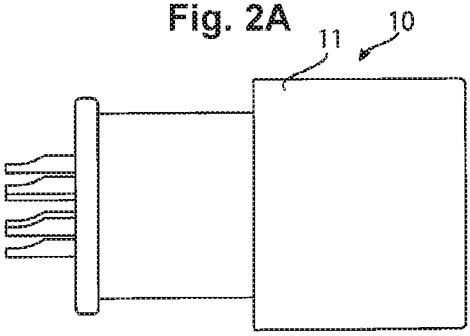
FIG. 2B is a side view of the first connector of FIG. 1A.
Figure 2C:
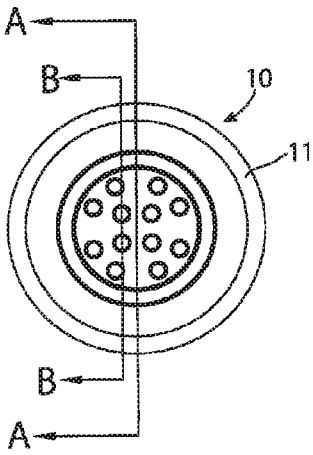
FIG. 2C is a rear view of the first connector of FIG. 1A.

A connector assembly according to an embodiment is shown in FIGS. 1A and 1B and includes a first connector 10 and a second connector 20 matable with the first connector 10. The first connector 10, shown in FIG. 1A, includes a plug housing 11 and a plurality of male contacts 12. The second connector 20, shown in FIG. 1B, includes a receptacle housing 21 and a plurality of female contacts 22 shown in FIGS. 5A and 5B. The plug housing 11 and the receptacle housing 21 may each also be referred to as an outer housing, and either may be a first outer housing or a second outer housing of the connector assembly.

When the first connector 10 and the second connector 20 are mated with each other, as shown in FIGS. 1A and 1B, a protrusion 212 disposed on a mating portion 211 of the second connector 20 and a key groove 112 disposed in a mating opening 111 of the first connector 10 are aligned with each other. After the alignment, mating of the mating portion 211 of the second connector 20 and the mating opening 111 of the first connector 10 is completed. Thereupon, a distal end of the male contact 12 of the first connector 10 is mated with the female contact 22 of the second connector 20, and the male contact 12 and the female contact 22 are electrically connected.

Figure 4A:
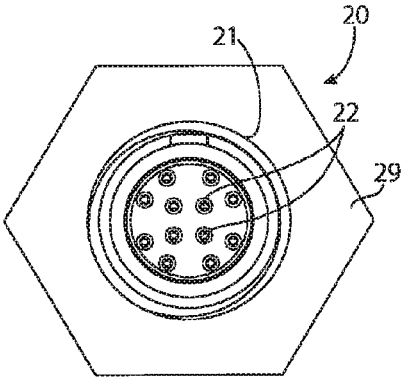
FIG. 4A is a front view of the second connector of FIG. 1B.
Figure 4B:
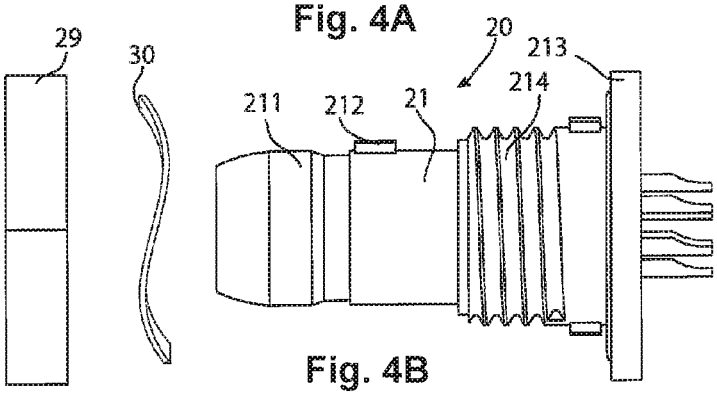
FIG. 4B is a side view of the second connector of FIG. 1B.
Figure 4C:
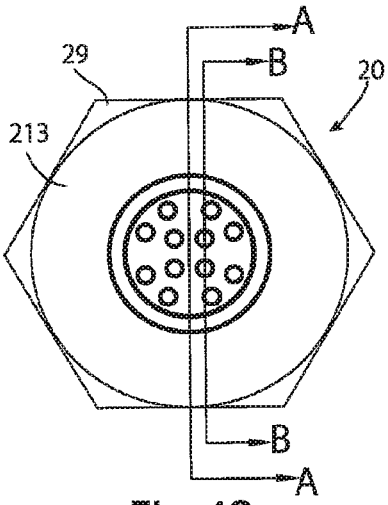
FIG. 4C is a rear view of the second connector of FIG. 1B.

As shown in FIG. 1B, a flange portion 213 is provided at a rear end portion of the receptacle housing 21 of the second connector 20. An external thread 214, shown in FIG. 4B, configured to be screwed into an internal thread 291, shown in FIGS. 5A and 5B, of a nut 29 is provided between the flange portion 213 and the mating portion 211. A panel is held between the flange portion 213 and the nut 29, and the second connector 20 is secured to the panel. A washer 30, shown in FIG. 4B, preventing looseness of the nut 29 is positioned between the nut 29 and the panel.

Figure 3A:
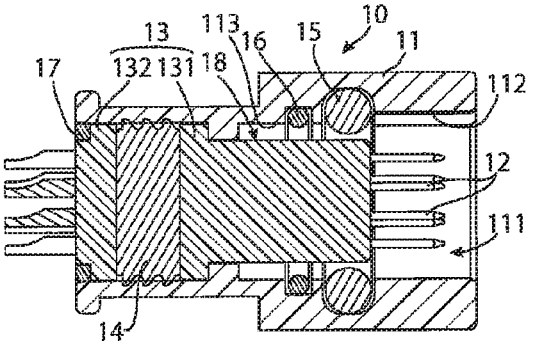
FIG. 3A is a sectional side view of the first connector of FIG. 1A taken along line A-A of FIG. 2C.
Figure 3B:
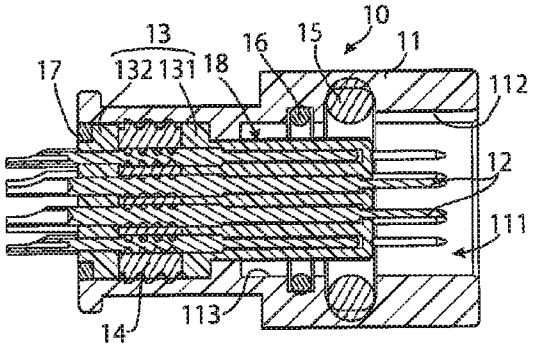
FIG. 3B is a sectional side view of the first connector of FIG. 1A taken along line B-B of FIG. 2C.

The first connector 10 is shown in FIGS. 2A-2C, 3A, and 3B. As shown in FIGS. 3A and 3B, a subassembly 18 having the male contacts 12 and an inner housing 13 accommodating the male contacts 12 are accommodated in the plug housing 11. The subassembly 18 has a seal member 14 for waterproofing. The seal member 14 is disposed between a front housing 131 and a rear housing 132 of the inner housing 13. The subassembly 18 may also be referred to as a first subassembly, the inner housing 13 may be referred to as a first inner housing, and the seal member 14 may be referred to as a first seal member.

As shown in FIGS. 3A and 3B, a coil spring 15 and an O-ring 16 are also positioned inside the plug housing 11. The coil spring 15 is adapted to lock the mating portion 211 of the second connector 20 mated with the first connector 10. The O-ring 16 is interposed between an inner wall face 113 of the plug housing 11 and an external wall face of the receptacle housing 21, the mating portion 211 of the second connector 20, and forms a waterproof seal between the first connector 10 and the second connector 20.

The subassembly 18, as shown in FIGS. 3A and 3B, includes the male contacts 12, the inner housing 13, and the seal member 14 accommodated in the plug housing 11 through the rear of the plug housing 11. A retaining member 17 having the shape of a ring is press-fitted into a rear end portion of the plug housing 11 to secure the subassembly 18 in the plug housing 11.

Figure 5A:
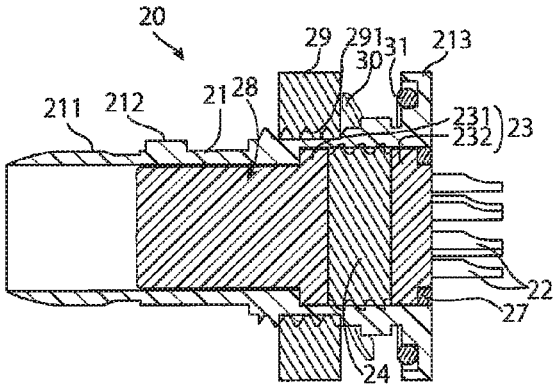
FIG. 5A is a sectional side view of the second connector of FIG. 1B taken along line A-A of FIG. 4C.
Figure 5B:
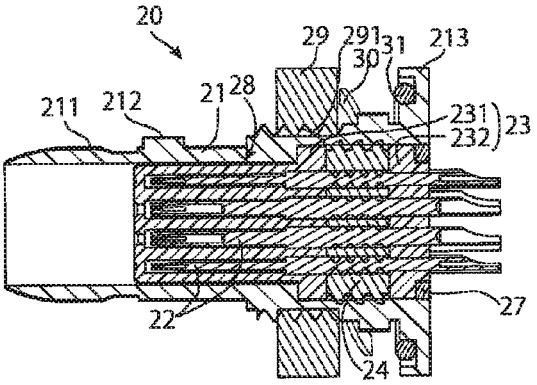
FIG. 5B is a sectional side view of the second connector of FIG. 1B taken along line B-B of FIG. 4C.

The second connector 20 is shown in FIGS. 4A-4C, 5A, and 5B. As shown in FIGS. 5A and 5B, a subassembly 28 having the female contacts 22 and an inner housing 23 accommodating the female contacts 22 is accommodated in the receptacle housing 21. The subassembly 28 has a seal member 24 for waterproofing. The seal member 24 is disposed between a front housing 231 and a rear housing 232 of the inner housing 23. The subassembly 28 may also be referred to as a second subassembly, the inner housing 23 may also be referred to as a second inner housing, and the seal member 24 may also be referred to as a second seal member.

The inner housing 23 and the seal member 24, shown in FIGS. 5A and 5B, are identical in shape and identical in dimensions with the inner housing 13 and the seal member 14 of the subassembly 18 shown in FIGS. 3A and 3B. The subassembly 18 of the first connector 10 and the subassembly 28 of the second connector 20 are different from each other only in that they have contacts different in shape; the male contacts 12 and the female contacts 22.

As shown in FIGS. 5A and 5B, the subassembly 28 including the female contacts 22, the inner housing 23, and the seal member 24 is inserted into the receptacle housing 21 through the rear of the receptacle housing 21. A retaining member 27 having the shape of a ring is press-fitted into a rear end portion of the receptacle housing 21 to secure the subassembly 28 in the receptacle housing 21. An O-ring 31 forming a waterproof seal between the second connector 20 and the panel is positioned at the flange portion 213 of the receptacle housing 21.

Figure 6A:
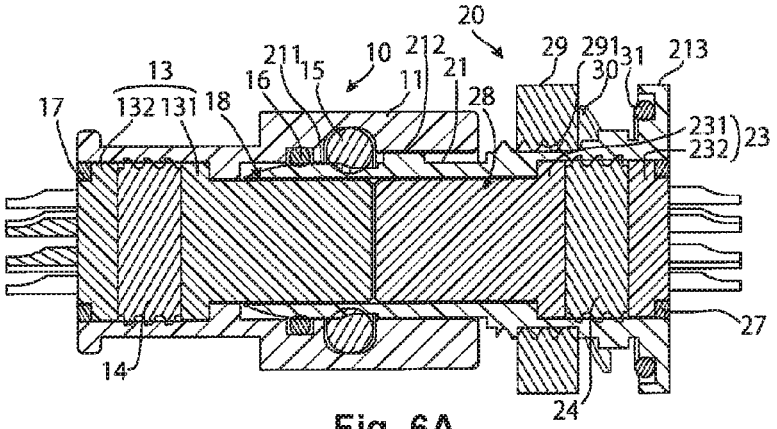
FIG. 6A is a sectional side view of the first connector and the second connector in a mated state.
Figure 6B:
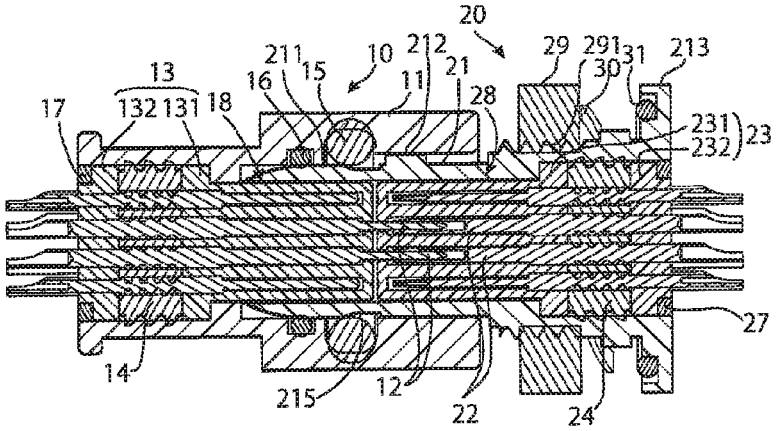
FIG. 6B is a sectional side view of the first connector and the second connector in the mated state.

The first connector 10 and the second connector 20 are shown in a mated state in FIGS. 6A and 6B. Once the first connector 10 and the second connector 20 are mated together, as shown in FIG. 6B, the distal end portion of the male contact 12 of the first connector 10 and the female contact 22 of the second connector 20 are mated together and are electrically connected together. The mating portion 211 of the second connector 20 has its groove 215 engaged with the coil spring 15 inside the plug housing 11. A seal is made between the first connector 10 and the second connector 20 with the O-ring 16.

Figure 7A:
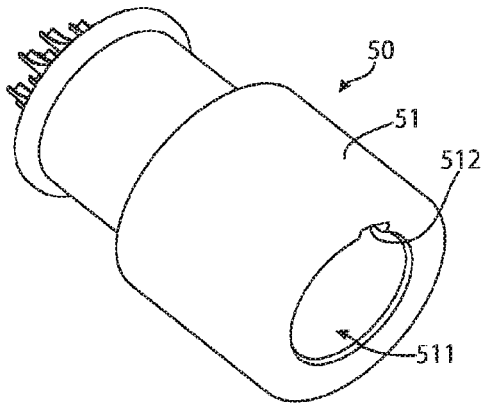
FIG. 7A is a perspective view of a first connector according to another embodiment.
Figure 7B:
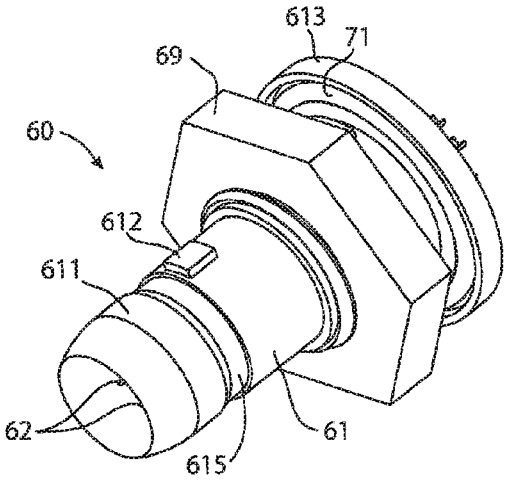
FIG. 7B is a perspective view of a second connector matable with the first connector of FIG. 7A.
Figure 8A:
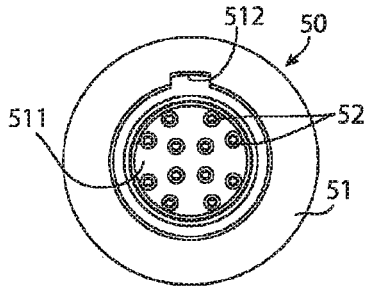
FIG. 8A is a front view of the first connector of FIG. 7A.
Figure 8B:
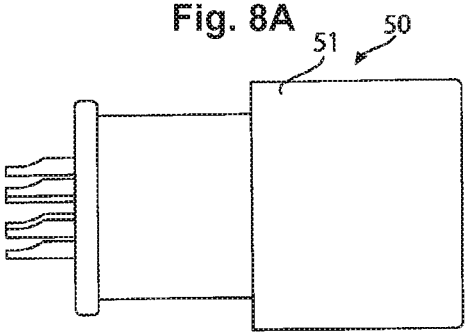
FIG. 8B is a side view of the first connector of FIG. 7A.
Figure 8C:
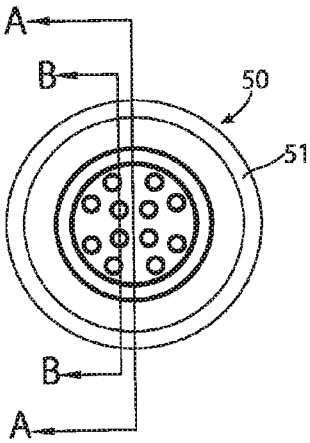
FIG. 8C is a rear view of the first connector of FIG. 7A.

A connector assembly according to another embodiment is shown in FIGS. 7A and 7B and includes a first connector 50 and a second connector 60 matable with the first connector 50.

Figure 9A:
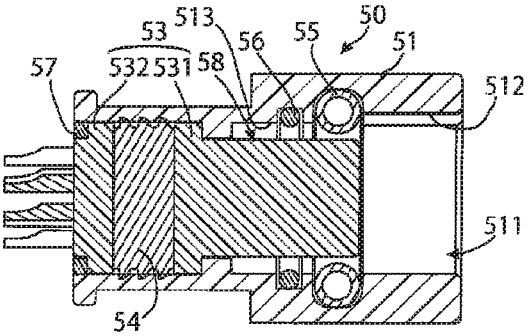
FIG. 9A is a sectional side view of the first connector of FIG. 7A taken along line A-A of FIG. 8C.
Figure 9B:
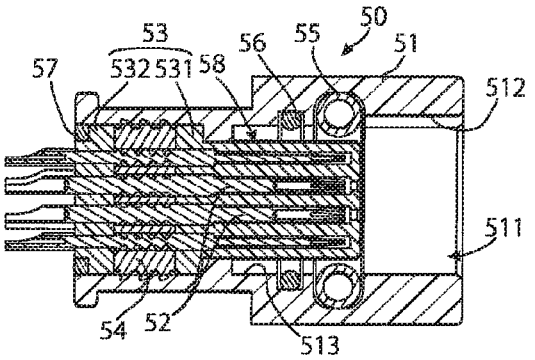
FIG. 9B is a sectional side view of the first connector of FIG. 7A taken along line B-B of FIG. 8C.

The first connector 50, as shown in FIG. 7A, includes a plug housing 51 and a plurality of female contacts 52 shown in FIG. 9B. In comparison with the first connector 10 shown in FIG. 1A, the plug housings 51, 11 in both the first connectors 50, 10 are housings identical in shape and identical in dimensions. However, while the first connector 10 shown in FIG. 1A has the male contacts 12, the first connector 50 shown in FIG. 7A has the female contacts 52. The female contact 52 is a contact identical with the female contact 22 of the second connector 20 shown in FIG. 1B.

Figure 10A:
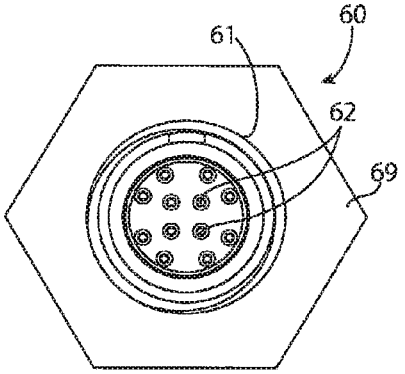
FIG. 10A is a front view of the second connector of FIG. 7B.
Figure 10B:
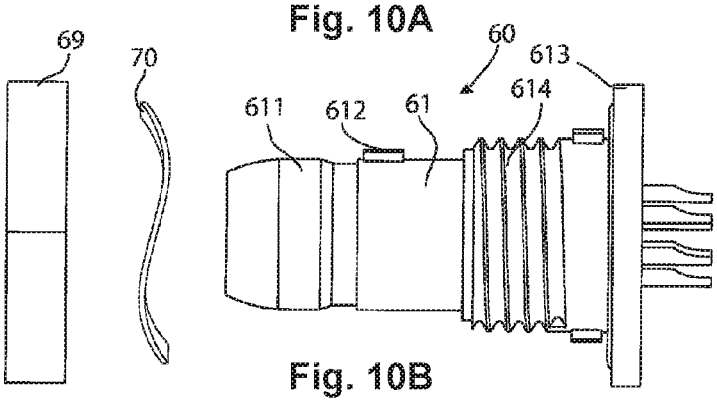
FIG. 10B is a side view of the second connector of FIG. 7B.
Figure 10C:
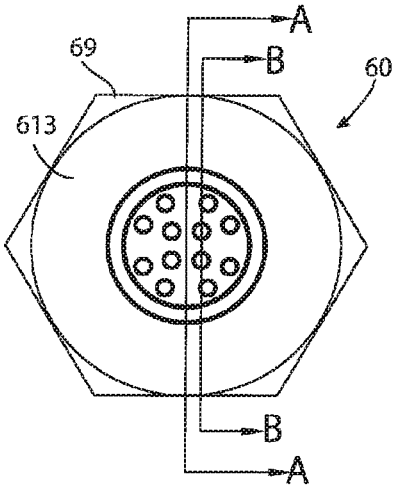
FIG. 10C is a rear view of the second connector of FIG. 7B.
Figure 11A:
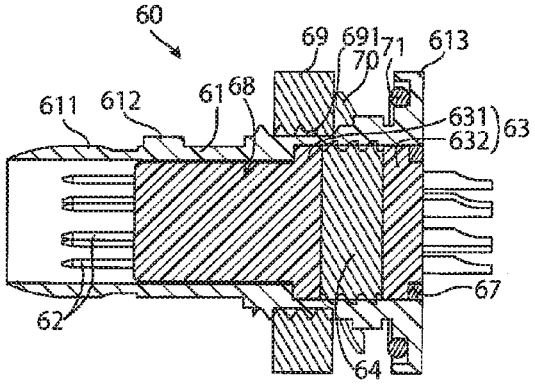
FIG. 11A is a sectional side view of the second connector of FIG. 7B taken along line A-A of FIG. 10C.
Figure 11B:
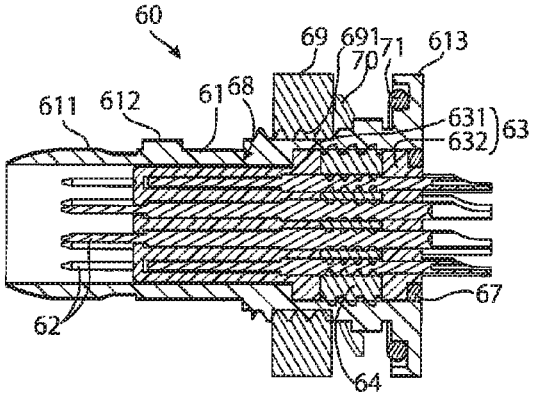
FIG. 11B is a sectional side view of the second connector of FIG. 7B taken along line B-B of FIG. 10C.

The second connector 60, shown in FIG. 7B, includes a receptacle housing 61 and a plurality of male contacts 62 shown in FIGS. 11A and 11B. In comparison with the second connector 20 shown in FIG. 1B, the receptacle housings 61, 21 in both the second connectors 60, 20 are housings identical in shape and identical in dimensions. The second connector 60 shown in FIG. 7B is also identical with the second connector 20 shown in FIG. 1B in that a panel is held between a flange portion 613 of the second connector 60 and a nut 69 screwed on an external thread 614 shown in FIG. 10B. A washer 70, shown in FIG. 10B, preventing looseness of the nut 69 is positioned between the nut 69 and the panel. The second connector 60 is also identical with the second connector 20 in that an O-ring 71, shown in FIGS. 11A and 11B, forming a waterproof seal between the second connector 60 and the panel is positioned at the flange portion 613 of the receptacle housing 61. However, while the second connector 20 has the female contacts 22, the second connector 60 has the male contacts 62. The male contact 62 is identical with the male contact 12 of the first connector 10 shown in FIG. 1A.

The plug housing 51 and the receptacle housing 61 may each also be referred to as an outer housing, and either may be a first outer housing or a second outer housing of the connector assembly.

Mating of the first connector 50 and the second connector 60 is identical with the mating of the first connector 10 and the second connector 20, except that the female contacts 52 and the male contacts 62 have an opposite relationship. When the first connector 50 and the second connector 60 shown in FIGS. 7A and 7B are mated together, a protrusion 612 provided on a mating portion 611 of the second connector 60 and a key groove 512 provided in a mating opening 511 of the first connector 50 are aligned with each other. After the alignment, mating of the mating portion 611 of the second connector 60 and the mating opening 511 of the first connector 50 is completed. A distal end of the male contact 62 of the second connector 20 is mated with the female contact 52 of the first connector 50, and the female contact 52 and the male contact 62 are electrically connected together.

The first connector 50 is shown in FIGS. 8A-8C, 9A, and 9B. As shown in FIGS. 9A and 9B, a subassembly 58 having the female contacts 52 and an inner housing 53 accommodating the female contacts 52 is disposed in the plug housing 51. The subassembly 58 has a seal member 54 for waterproofing. The seal member 54 is disposed between a front housing 531 and a rear housing 532 of the inner housing 53. The subassembly 58 may be referred to as a second subassembly and the inner housing 53 may be referred to as a second inner housing.

As shown in FIGS. 9A and 9B, a coil spring 55 and an O-ring 56 are also positioned inside the plug housing 51. The coil spring 55 is adapted to lock the mating portion 611 of the second connector 60 mated with the first connector 50. The O-ring 56 is interposed between an inner wall face 513 of the plug housing 51 and an external wall face of the receptacle housing 61, the mating portion 611 of the second connector 60, and forms a waterproof seal between the first connector 50 and the second connector 60. The subassembly 58 including the female contacts 52, the inner housing 53, and the seal member 54 is inserted into the plug housing 51 through the rear of the plug housing 51. A retaining member 57 having the shape of a ring is press-fitted into a rear end portion of the plug housing 51 to secure the subassembly 58 in the plug housing 51.

The second connector 60 is shown in FIGS. 10A-10C, 11A, and 11B. As shown in FIGS. 11A and 11B, a subassembly 68 having the male contacts 62 and an inner housing 63 accommodating the male contacts 62 is accommodated in the receptacle housing 61. The subassembly 68 has a seal member 64 for waterproofing. The seal member 64 is disposed between a front housing 631 and a rear housing 632 of the inner housing 63. The subassembly 68 may be referred to as a first subassembly and the inner housing 63 may be referred to as a first inner housing.

The inner housing 63 is identical in shape and identical in dimensions with the inner housing 53 of the subassembly 58 of the first connector 50. The seal member 64 is also identical in shape and identical in dimensions with the seal member 54. The first subassembly 58 and the second subassembly 68 are different from each other only in that they have contacts different in shape; the female contact 52 and the male contact 62.

The subassembly 68 including the male contacts 62, the inner housing 63, and the seal member 64 is inserted into the receptacle housing 61 through the rear of the receptacle housing 61. As shown in FIGS. 11A and 11B, a retaining member 67 having the shape of a ring is press-fitted into a rear end portion of the receptacle housing 61 to secure the subassembly 68 in the receptacle housing 61.

The inner housings 53, 63 constituting the subassemblies 58, 68 are identical with each other and the seal members 54, 64 are also identical with each other. Furthermore, these inner housings 53, 63 are also identical with the inner housings 13, 23 in the embodiment of FIGS. 1A-6B. The seal members 54, 64 are also identical with the seal members 14, 24 in the embodiment of FIGS. 1A-6B. Likewise, the female contact 52 of the subassembly 58 is identical with the female contact 22 of the subassembly 28, and the male contact 62 of the subassembly 68 is identical with the male contact 12 of the subassembly 18. The subassembly 18 is identical with the subassembly 68 and the subassembly 28 is identical with the subassembly 58. In other words, the subassembly 28 is accommodated in the receptacle housing 21 in the embodiment of FIGS. 1A-6B, but accommodated in the plug housing 51 in the embodiment of FIGS. 7A-12B. Similarly, the subassembly 18 is accommodated in the plug housing 11 in the embodiment of FIGS. 1A-6B, but accommodated in the receptacle housing 61 in the embodiment of FIGS. 7A-12B. In the connector assembly described herein, a connector can be configured as a connector provided with a male contact or as a connector provided with a female contact regardless of whether the connector has a plug housing or a receptacle housing.

Figure 12A:
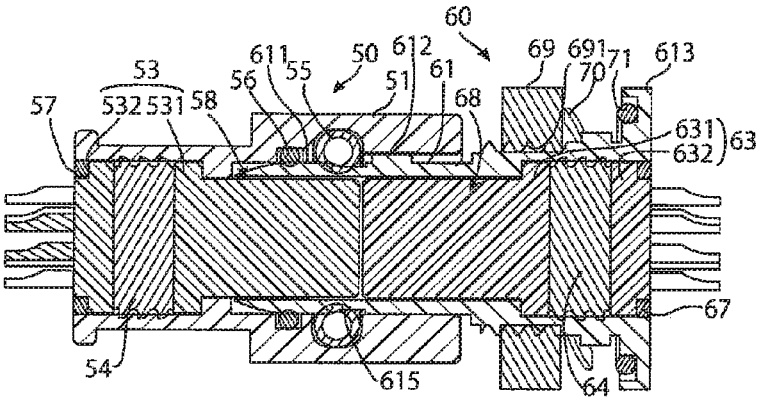
FIG. 12A is a sectional side view of the first connector and the second connector in a mated state.
Figure 12B:
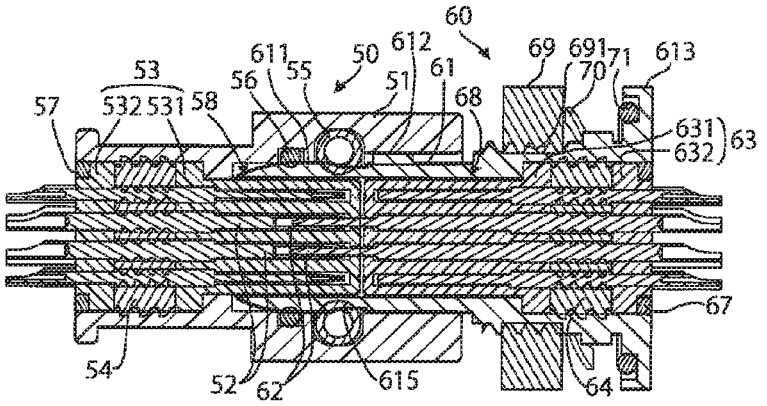
FIG. 12B is a sectional side view of the first connector and the second connector in the mated state.

The first connector 50 and the second connector 60 are shown in a mated state in FIGS. 12A and 12B. When the first connector 50 and the second connector 60 are mated together, as shown in FIG. 12B, the female contact 52 of the first connector 50 is mated with the distal end portion of the male contact 62 of the second connector 60, and the female contact 52 and the male contact 62 are electrically connected together. The mating portion 611 of the second connector 60 has its groove 615 engaged with the coil spring 55 inside the plug housing 51. A seal is made between the first connector 50 and the second connector 60 with the O-ring 56.

Though the combination of a plug housing and a receptacle housing is described herein in the embodiments of the connector assemblies, the present invention does not intend to limit the shapes of the housings defining the respective external shapes of the first connector and the second connector, and the housings are only required to have shapes mated with each other.

What is claimed is:

1. A connector assembly, comprising:

a first subassembly having a first contact arrangement of a first configuration, and a first inner housing accommodating the first contact arrangement, the first inner housing comprising:

a front housing;

a rear housing; and a first seal member arranged between and separating the front housing from the rear housing;

a second subassembly having a second contact arrangement of a second configuration, distinct from the first configuration, and configured to be mated with the first contact arrangement, a second inner housing accommodating the second contact arrangement, and a second seal member having a shape identical to that of the first seal member;

a first connector having a first outer housing accommodating one of the first subassembly and the second subassembly and capable of accommodating both the first subassembly and the second subassembly; and a second connector matable with the first connector and having a second outer housing accommodating the other of the first subassembly and the second subassembly and capable of accommodating both the first subassembly and the second subassembly.

2. The connector assembly of claim 1, wherein the first inner housing and the second inner housing each have an identical shape.

3. The connector assembly of claim 1, wherein the first contact arrangement includes at least one male contact and the second contact arrangement includes at least one female contact, the second subassembly including only female contacts.

4. The connector assembly of claim 1, wherein the first and second contact arrangements are non-hermaphroditic contact arrangements.

5. The connector assembly of claim 1, wherein a first end of the second contact arrangement is matable with the first contact arrangement, and wherein a second end of the second contact arrangement, opposite the first end, protrudes from a rear of the first connector or the second connector when the second subassembly is accommodated therein.

6. The connector assembly of claim 1, wherein the first outer housing is a plug housing and the second outer housing is a receptacle housing.

7. The connector assembly of claim 6, wherein the first connector has a retaining member disposed in a rear end portion of the plug housing and securing the first subassembly in the plug housing.

8. The connector assembly of claim 6, wherein a mating portion of the second connector is inserted into a mating opening of the first connector when the second connector is mated with the first connector.

9. The connector assembly of claim 8, wherein the mating portion has a protrusion corresponding to a key groove disposed in the mating opening.

10. The connector assembly of claim 8, wherein a rear end portion of the receptacle housing formed continuously with a remainder of the receptacle housing has a flange portion fixedly attached to an end thereof.

11. The connector assembly of claim 10, wherein the receptacle housing has an external thread disposed between the flange portion and the mating portion.

12. The connector assembly of claim 11, wherein the second connector has a nut with an internal thread engaging the external thread, the nut being rotatable on the external thread independently from a remainder of the receptacle housing.

13. The connector assembly of claim 8, wherein the first connector has a coil spring disposed in the plug housing and adapted to lock to an annular groove formed in a generally cylindrical surface of the mating portion of the second connector.

14. The connector assembly of claim 13, wherein the first connector has an o-ring disposed in the plug housing between an inner wall face of the plug housing and the mating portion of the second connector.

15. A connector assembly, comprising:

a first subassembly having a first contact arrangement of a first configuration, and a first inner housing accommodating the first contact arrangement, the first contact arrangement of the first configuration not matable with another contact arrangement of the first configuration;

a second subassembly having a second contact arrangement of a second configuration, distinct from the first configuration, and configured to be mated with the first contact arrangement, and a second inner housing accommodating the second contact arrangement;

a first connector having a first outer housing accommodating one of the first subassembly and the second subassembly and capable of accommodating both the first subassembly and the second subassembly; and a second connector matable with the first connector and having a second outer housing accommodating the other of the first subassembly and the second subassembly and capable of accommodating both the first subassembly and the second subassembly.

16. The connector assembly of claim 15, wherein the first subassembly has a first seal member and the second subassembly has a second seal member.

17. The connector assembly of claim 16, wherein the first seal member and the second seal member each have an identical shape.

18. The connector assembly of claim 17, wherein the first inner housing has a front housing and a rear housing.

19. The connector assembly of claim 18, wherein the first seal member is disposed between and separates the front housing and the rear housing.

20. A connector assembly, comprising:

a first subassembly having a male contact and a first inner housing accommodating the male contact, the first inner housing comprising:

a first front housing;

a first rear housing; and a first seal member arranged between and separating the first front housing from the first rear housing;

a second subassembly having a female contact configured to be mated with the male contact, a second inner housing accommodating the female contact, and a second seal member having a shape identical to that of the first seal member;

a first connector having a first outer housing accommodating one of the first subassembly and the second subassembly and capable of accommodating both the first subassembly and the second subassembly; and a second connector matable with the first connector and having a second outer housing accommodating the other of the first subassembly and the second subassembly and capable of accommodating both the first subassembly and the second subassembly.

* * * * *